US009481015B2

(12) United States Patent
Schons

(10) Patent No.: US 9,481,015 B2
(45) Date of Patent: Nov. 1, 2016

(54) APPARATUS AND METHOD FOR SORTING OUT COINS FROM BULK METAL

(71) Applicant: Georg Schons, Eigeltingen (DE)
(72) Inventor: Georg Schons, Eigeltingen (DE)

( * ) Notice: Subject to any disclaimer, the term of this patent is extended or adjusted under 35 U.S.C. 154(b) by 0 days.

(21) Appl. No.: 14/400,664
(22) PCT Filed: Oct. 12, 2012
(86) PCT No.: PCT/EP2012/070302
§ 371 (c)(1),
(2) Date: Nov. 12, 2014
(87) PCT Pub. No.: WO2013/060584
PCT Pub. Date: May 2, 2013

(65) Prior Publication Data

US 2016/0016201 A1 Jan. 21, 2016

(30) Foreign Application Priority Data

Oct. 24, 2011 (WO) ..... PCT/EP2011/068527

(51) Int. Cl.
*B07B 13/05* (2006.01)
*G07D 3/02* (2006.01)
*B07B 1/14* (2006.01)

(52) U.S. Cl.
CPC ..... *B07B 13/05* (2013.01); *B07B 1/14* (2013.01); *G07D 3/02* (2013.01)

(58) Field of Classification Search
CPC ..... B07B 13/04; B07B 13/05; B07B 13/065; G07D 3/02
See application file for complete search history.

(56) References Cited

U.S. PATENT DOCUMENTS 755,937 A 3/1904 Richardson et al.
2,059,038 A 10/1936 Sala
(Continued)

FOREIGN PATENT DOCUMENTS

CH 189336 2/1937
DE 809493 4/1951
(Continued)

OTHER PUBLICATIONS

International Apin No. PCT/EP2012/07032 search report dated Feb. 19, 2013.

*Primary Examiner* — Joseph C Rodriguez
(74) *Attorney, Agent, or Firm* — Bachman & LaPointe, P.C.

(57) ABSTRACT

A sorting apparatus for sorting out coins from bulk metal, in particular from non-ferrous bulk metal and/or heavy bulk metal, includes a conveying system, provided with a conveyor belt (2), for conveying the bulk metal in a conveying direction (4) to a sorting slot (14) through which coins can pass and which is defined by a roller (10, 11), and, on the side opposite the roller (10, 11), by the conveyor belt (2), wherein the roller (10, 11) can be rotated about an axis of rotation (6, 7, 30, 31) by a drive such that the metal, which cannot be conveyed through the sorting slot (14) in the conveying direction (4), can be transported by the roller (10, 11) in a direction (13, 19, 22) leading away from the sorting slot (14) such that the metal can be removed at the side, wherein the sorting apparatus further comprises an apparatus for removing the metal, which is not conveyable through the sorting slot (14) in the conveying direction (4), and wherein the apparatus is embodied such that the removal of the metal to the two opposite sides of the conveyor belt takes place in an area in conveying direction (14) upstream of the roller (10, 11).

6 Claims, 3 Drawing Sheets

(56) References Cited

U.S. PATENT DOCUMENTS

| | | | | | |
|---|---|---|---|---|---|
| 2,964,181 | A | | 12/1960 | Demarest et al. | |
| 3,004,663 | A | | 10/1961 | Creoglio | |
| 3,621,854 | A | * | 11/1971 | Redman | G07D 9/008 453/56 |
| 4,609,110 | A | * | 9/1986 | Schulman | B07B 13/05 100/174 |
| 4,776,467 | A | | 10/1988 | Hayasaki | |
| 4,832,654 | A | * | 5/1989 | Stoeckli | G07D 3/125 453/56 |
| 5,806,686 | A | * | 9/1998 | Ecker | A23N 15/00 198/663 |
| 6,053,807 | A | * | 4/2000 | Metzger | G07D 9/008 194/347 |
| 7,971,880 | B2 | * | 7/2011 | Niwa | G07F 17/3297 273/138.1 |
| 8,640,878 | B2 | * | 2/2014 | Greve | B07B 13/04 198/604 |
| 9,199,281 | B2 | * | 12/2015 | Fourney | B65G 17/24 |

FOREIGN PATENT DOCUMENTS

| | | |
|---|---|---|
| DE | 36 37 835 | 6/1988 |
| DE | 37 24 240 | 2/1989 |
| DE | 43 01 319 | 7/1994 |
| EP | 0 865 005 | 9/1998 |
| FR | 2 805 765 | 7/2001 |
| SE | 91303 | 1/1938 |
| WO | 85/02134 | 5/1985 |

* cited by examiner

APPARATUS AND METHOD FOR SORTING OUT COINS FROM BULK METAL

BACKGROUND OF THE INVENTION

The invention relates to a sorting apparatus for sorting out coins from bulk metal as well as to a method for sorting out coins from bulk metal.

It is known that slag from waste incinerators contains coins. To date, these coins have not been sorted out industrially, but are further processed as heavy metal as part of a heavy metal fraction. To be able to sort coins from a metal fraction of a waste incinerator in a cost-effective manner, a corresponding sorting apparatus or a sorting method, respectively, must be able to handle large metal throughputs. In addition, the sorting apparatus must be robust and its purchase and upkeep needs to be cost-efficient. In addition, the coin loss is to be as low as possible.

It is known to recognize coins on a moving belt by means of sensor technology for metal recognition in combination with a camera and to blow them out by means of air nozzles. This method, however, only has net throughputs of less than 100 kg/h with a coin loss of more than 25% and an investment sum of approximately 1 million Euros per ton of throughput.

EP 0 865 005 A1 describes an apparatus for counting and/or sorting coins, wherein the coin sorting apparatus is not suitable for sorting out coins from bulk metal, in particular from a waste incinerator slag fraction. According to the publication, bulk coins, which are more or less correctly sorted, which can partially be contaminated by buttons, staples and paper clips and the like, must instead be placed. The apparatus comprises an inclined conveyor belt as well as a roller, which define a slot between one another. This slot serves to separate the coins. A chute and a coin plate for counting the coins are arranged downstream from the roller in conveying direction.

If bulk metal comprising a comparatively small coin portion were to be supplied in the case of the known sorting apparatus, the apparatus would fail. In particular the throughput would be much smaller than required.

Sorting apparatuses are known from fields outside of the subject area, for example a device for sorting peas according to size from DE 804 493 and a separating apparatus for peeled crabs from U.S. Pat. No. 2,964,181. Both apparatuses are characterized by a conveyor belt, which defines with a roller clearance. The product to be sorted is removed on one side. The known apparatuses are not intended and suitable for sorting coins from a waste incinerator slag fraction.

U.S. Pat. No. 3,004,663 A shows a sorting apparatus from a field outside of the subject area for sorting fruit and potatoes by means of a conveyor belt and rotating rollers. The sorting apparatus is not designed and intended for sorting out coins from bulk metal.

SUMMARY OF THE INVENTION

Based on the afore-mentioned state of the art, the invention is based on the task of specifying a sorting apparatus for sorting out coins from bulk metal, in particular from non-ferrous bulk metal and/or heavy bulk metal, which, on the one hand, is robust and which, on the other hand, is characterized by a high output rate. Preferably, the sorting apparatus is to be embodied such that the coin loss is small, preferably less than 1%, and such that the throughput rate is high, preferably more than 1000 kg of bulk metal per hour, whereby the investment costs are to be significantly reduced.

The task is furthermore to specify a correspondingly optimized method for operating such a sorting apparatus.

With regard to the sorting apparatus and with regard to the method, this task is attained/realized by means of the features disclosed herein.

Advantageous further developments of the invention are also specified herein. All of the combinations of at least two features disclosed in the description, the claims and/or the figures, fall within the scope of the invention. To avoid repetition, features, which are disclosed according to the apparatus shall also apply as having been disclosed and as being capable of being claimed according to the method. Features, which are disclosed according to the method shall likewise also apply as having been disclosed and as being capable of being claimed according to the apparatus.

In the case of the sorting apparatus according to the invention, the at least one slot is defined by a conveyor belt and at least one roller, which can in particular be driven by means of an electric motor, wherein the sorting slot is dimensioned such that the coins are conveyed through the sorting slot in a conveying direction, namely preferably horizontally, while the non-coin metal is held back at least for the most part. The at least one roller is thereby rotated such that a jamming of metal in the slot is prevented, that is, the roller, in particular a brush, preferably rotates opposite the conveying direction or applies a force to the metal parts in a direction away from the sorting slot, that is, the roller is rotated opposite the direction of rotation of the conveyor belt. Surprisingly high throughputs can be attained due to the sorting by means of rollers, and the sorting apparatus, which encompasses such a sorting mechanism, can be designed in a comparatively cost-efficient and simple manner.

A coin is thereby understood to be means of payment, which is preferably contoured in a circular manner and which is thin relative to the diameter, preferably minted or cast and in particular metallic, which is and/or was generally used as money.

The comparatively flat coins, which, for the most part, encompasses slag adhesions, can be separated from the residual metal (non-coin metals), in particular non-ferrous metals, which are significantly more irregular, by means of the sorting principle according to the invention. On principle, it is possible to supply the entire non-ferrous metal fraction of a slag to the sorting apparatus. It is much more effective, when heavy metals are handled.

It also makes sense to first separate a non-ferrous metal fraction into aluminum and heavy metals once again and to only supply the heavy metals to the sorting apparatus. It turned out to be particularly advantageous, when particularly small metal parts and particularly large metal parts are sorted out in at least one upstream separating step, in particular screening step. In particular, parts comprising a diameter of larger than 100 mm, preferably larger than 50 mm, more preferably larger than 38 mm, as well as parts comprising a diameter of less than 10 mm, preferably less than 15 mm, should be sorted out.

The invention is furthermore based on the idea of equipping the sorting apparatus for sorting coins from bulk metal, in the case of which at least one sorting slot is defined according to the invention by a conveyor belt for the bulk metal and by a roller, with means, which ensure that the metal of the bulk metal, which cannot be conveyed through the sorting slot in the conveying direction, in particular from a waste incinerator slag fraction, is not only removed on one side, but on two opposites sides of the conveyor belt, whereby it is particularly preferred, when the material removal takes place at least approximately evenly on both sides. The throughput is increased significantly due to the above-mentioned measure according to the invention. It is particularly preferred, when the sorting apparatus does not only encompass a sorting slot, which is defined by the conveyor belt and a roller, but when a plurality of sorting slots, which are arranged downstream from one another, are defined in the conveying direction by the conveyor belt and by a plurality of rollers, whereby it is even more preferred, when the slot width decreased vertically to the surface extension of the conveyor belt from sorting slot to sorting slot of the conveying direction.

In the case of a sorting apparatus comprising a plurality of sorting slots, which are arranged downstream from one another, it is preferred, when the removal takes place upstream of a plurality of the rollers, in particular upstream of all of the rollers, on two opposite sides of the conveyor belt.

With regard to the arrangement and embodiment of the means for two-sided removal of the metal, which cannot be conveyed through the sorting slot in the conveying direction, it is preferred when they provide for a removal of the metal in an area in conveying direction upstream of the roller, wherein the removal preferably takes place directly within the first 20 cm upstream of the respective roller.

There are different options with regard to the concrete embodiment of the means for removing the metal, which cannot be conveyed through the sorting slot in the conveying direction on two opposite sides at an angle to the conveying direction. Preferably, the rollers are part of these means and are thereby contoured such that the metal on the two opposite sides can be removed in an area upstream of the corresponding roller. For this purpose, the rollers should be contoured such that a part, in particular approximately half of the metal, which cannot be conveyed, receives a conveying impulse in the one lateral direction and the other part receives a conveying impulse into the other, opposite lateral direction. For example, this can take place in that the at least one roller encompasses two contour sections, for example in the form of counter-rotating coils or, for example, rings, which are arranged parallel to one another and which are inclined relative to a radial plane of the roller, which—ensure a lateral force impulse. There are different options with regard to the embodiment of the contour, in particular of the coils and/or rings. For example, they can be formed by bristles, which is particularly preferred, or also from solid material, for example a plastic material.

To transport the metal in two different directions, the roller is preferably provided with two contour sections, which, for example, encompass a counter-rotating helical surface structure or surface structures, which are inclined in different directions. In any event, the roller is preferably contoured such that the non-coin material experiences a force component towards both removal sides. In the event that the at least one sorting roller is embodied as bristle roller, it is particularly advantageous to arrange the bristles accordingly, in particular helically or in the form of parallel, sloping strands of bristles, whereby it is significant that a force is applied to non-coin material towards both removal sides, whereby force is applied to the left half towards the left removal side and to the right half of the non-coin material towards the right removal side, preferably at least approximately from the middle of the belt.

Instead of contour rings, which are circumferential, inclined and which are preferably arranged parallel to one another, provision can also be made for partially annular contours, whereby it is essential that a force is applied in lateral direction as well as opposite the conveying direction.

On principle, it is possible and preferred to provide for a one-part roller, which preferably extends vertically to the conveying direction and thus vertically to the longitudinal extension of the conveyor belt. To apply a force to the non-coin material on both opposite sides, it is also possible to provide for two (partial) rollers instead of for a single roller, and to arrange them at an angle to one another, in particular in arrow form, that is, neither vertically to the conveying direction, nor in conveying direction.

For example, the rollers or the axes of rotation thereof, respectively, can be arranged at a 45° incline to the conveying direction, so that they draw an angle of 90°. In the alternative, other angles can be realized.

In the alternative or in addition to a contouring of the roller as described above and/or to the provision of partial rollers, it is preferably possible to contour the conveyor belt such that the material removal of the metal is carried out to the two opposite sides. For this purpose, provision can be made, for example, for contour sections, which are arranged in an arrow-shaped manner, whereby it is particularly preferred, when the formed arrow tip points in conveying direction. It is also possible to provide for two sections comprising contour sections, which are inclined in different directions, e.g. parallel, wherein all of the embodiments have in common that the lateral force component thereof results on the non-coin material, which is conveyed by means of the roller opposite the conveyor belt contour. Preferably, the contour of the conveyor belt is embodied of solid material, in particular of the material of the conveyor belt.

Depending on the design of the sorting apparatus, the material can be removed on both opposite sides into a common or separate container and/or into a common or separate free fall chutes. An embodiment, in the case of which the material is removed on both sides onto a moved removal conveyor belt is particularly advantageous, wherein a common or a separate removal conveyor belt can be assigned to the sides. The alternative comprising at least one removal conveyor belt is advantageous in particular when a plurality of rollers, in particular brushes, are arranged downstream from one another in the conveying direction and when a removal of non-coin material takes place at every sorting slot, in particular in the two opposite directions. In other words, such a removal belt can be assigned to a plurality of sorting slots.

Cleaning agents, for example in the form of a brush and/or scraper for cleaning the subsurface of the conveyor belt, are preferably located below the conveyor belt.

The invention also leads to a method for sorting out coins from bulk metal (preferably a slag fraction), in particular from non-ferrous bulk metal, preferably from heavy bulk metal, whereby an apparatus, which is embodied according to the principle of the invention, is used for this purpose. It is the core idea of the method to use the conveyor belt to convey the bulk metal to a sorting slot, which is defined by the conveyor belt and at least one roller, and to remove the non-coin material on both opposite sides laterally of the conveyor belt. Coins are caught in an area downstream from the at least one sorting slot and are post-treated, if necessary. It is the core of the method to apply a force to the non-coin material not only in one direction away from the sorting slot by means of the roller, but to distribute the non-coin material, preferably equally, to two opposite removal sides, in particular vertically to the conveying direction, for the purpose of which a force is applied to a part of the non-coin material, in particular to half of it, in the one lateral direction and the other part in the other (opposite) lateral direction. To create corresponding force impulses in two opposite sides, it is preferred to contour the at least one roller and/or the conveyor belt accordingly.

BRIEF DESCRIPTION OF THE DRAWINGS

Further advantages, features and details of the invention follow from the following description of preferred exemplary embodiments as well as by means of the drawing.

The same elements and elements comprising the same function are identified with the same reference numerals in the figures.

DETAILED DESCRIPTION

Figure 1A:
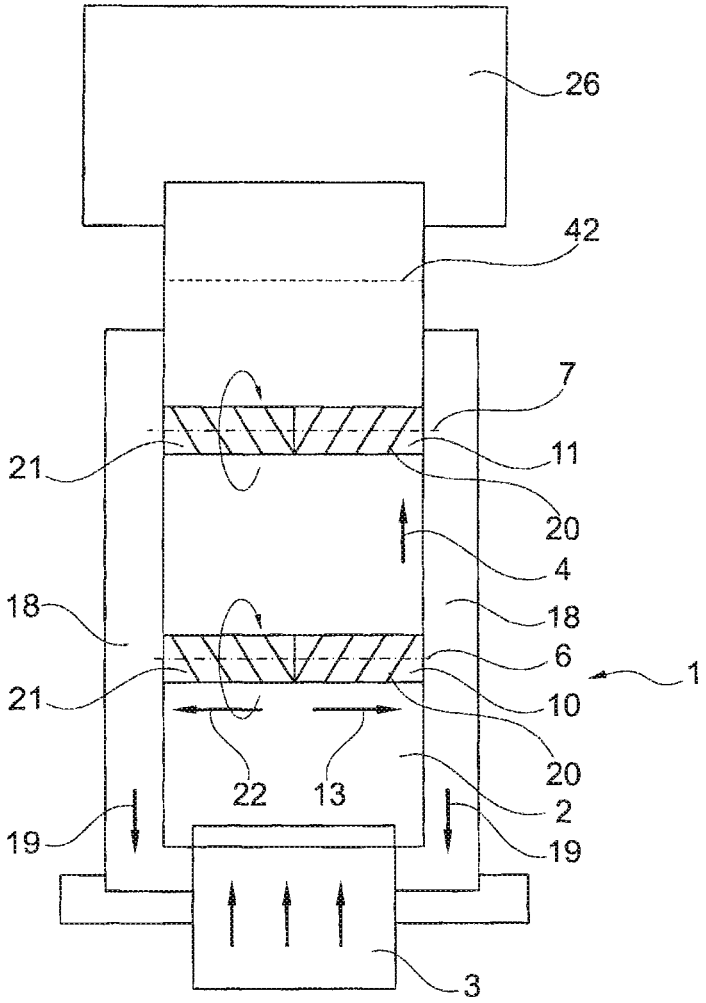
FIG. 1*a* shows a top view onto a first exemplary embodiment of a sorting apparatus, in the case of which sorting slots are in each case formed by a roller, which is embodied as a brush, and by a conveyor belt, wherein, in the case of the exemplary embodiment, the rollers are embodied such that metal, which cannot be conveyed through the sorting slots, is removed on two opposite sides of a conveyor belt.
Figure 1B:
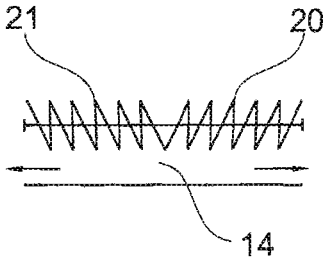
FIG. 1*b* shows a front view onto a device according to FIG. 1*a*, more exactly a view onto a sorting slot, which is defined by a roller, which is embodied as brush, and by the conveyor belt.

FIGS. 1*a* and 1*b* shows a possible embodiment of a sorting apparatus 1 for carrying out a sorting method embodied according to the concept of the invention.

The sorting apparatus 1 comprises a conveyor belt 2, which conveys bulk metal, which is placed by means of a vibrating unit 3, from a waste incinerator in a conveying direction 4.

In the shown exemplary embodiment, the sorting apparatus 1 comprises a plurality of rollers 10, 11, which are embodied as brushes herein and which are in each case driven so as to rotate about an axis of rotation 6, which runs vertically, that is, perpendicular or normal, to the conveying direction 4, by means of a non-illustrated drive. As can be seen from FIG. 1*a*, a total of two rollers 10, 11 are arranged downstream from one another in the conveying direction 4, wherein provision is preferably made for more than two rollers. The rollers 10, 11 are arranged parallel to one another and are operated at 180 rpm. The conveyor belt is operated at a speed of 0.4 m/s. The first roller 10 defines a first sorting slot 14 with the conveyor belt 2 and the second roller 11 defines a second sorting slot with the conveyor belt 2, wherein the slot width (distance between roller and conveyor belt) of the first sorting slot 14 is larger than the slot width of the second sorting slot. Generally, it is preferred, when the sorting slot width decreases, starting at the first sorting slot 14 to the last sorting slot. In the shown exemplary embodiment, the slot width of the first sorting slot, that is, the minimum distance between the bristles of the first roller and the conveyor belt 2 is 15 mm. The slot width of the second sorting slot is 10 mm.

As mentioned, provision is preferably made for further sorting slots, wherein the slot width of the third sorting slot is then preferably 5 mm and the slots of the fourth sorting slot is 3.5 mm. This dimensioning is based on the consideration that, as a rule, coins encompass a maximum thickness extension of 3.2 mm. Due to possible slag adhesions, the last sorting slot is thus chosen such that these coins with slag adhesions can still pass through the sorting slot.

The rollers 10, 11 are arranged so as to be height-adjustable, so as to be able to adjust the slot width manually or, in the alternative, by means of an actuator.

In the shown exemplary embodiment, the rollers 10, 11 in each case encompass two sections 20, 21, which are arranged vertically to the conveying direction 4 next to one another and which are contoured such that the metal, which cannot be conveyed through the respective sorting slot, is removed evenly on two opposite sides of the conveyor belt 2 vertically to the conveying direction 4. In the shown exemplary embodiments, the bristles of the sections 20, 21 are arranged as counter-rotating coils, which transport the metal, which cannot be conveyed through the respective sorting slot, with a force component towards the respective lateral direction. Due to the above measures, the metal is thus conveyed in two opposite directions 22, 13.

Removal belts 18, which are operated in a direction 19 opposite the conveying direction 4, are located on both opposite sides of the conveyor belt 2 below the latter, whereby it goes without saying that, in the alternative, the removal belts 18 can also be operated in conveying direction 4 or vertically thereto. Instead of or in addition to a removal belt, provision can also be made for free fall chutes or for a common free fall chute. It is also possible to provide for a common removal belt.

As already suggested, the rollers 10, 11 are driven by means of an electric motor (not illustrated), whereby it goes without saying that alternative drive options can be realized. The rollers 10, 11 are thereby rotated such that they apply a force to the bulk metal away from the respective sorting slot. In other words, the rollers rotate such that, in this case, the bristles thereof or other contour sections in the sorting slot move opposite the conveying direction 4. Viewed from the right-hand side of the drawing plane into the left-hand side of the drawing plane, the rollers 10, 11 thus rotate clockwise, so that the material, which cannot be conveyed through the respective sorting slot, is transported on the one hand with a force component opposite the conveying direction 4 as well as in the direction 22 or, in the alternative, in the direction 13.

The coins can pass through the sorting slots lying flat on the conveyor belt 2 in conveying direction 4. The coins are thus moved in the conveying direction 4.

A collecting tray 26 for the coins, which is preferably embodied for preventing unauthorized access, is located at the end of the conveyor belt 2. It goes without saying that provision can also be made for a conveyor belt, which is covered in particular, instead of for a collecting tray 26.

Cleaning agents 42, here in the form of a brush for cleaning the subsurface of the conveyor belt 2, are located below the conveyor belt 2.

It is remarkable that the slag bulk metal is placed onto the conveyor belt 2 at least approximately across the entire width thereof by means of the vibrating unit 3 (alternative supply options can be realized), wherein the conveyor belt 2 conveys the bulk metal in the conveying direction 4.

Figure 2A:
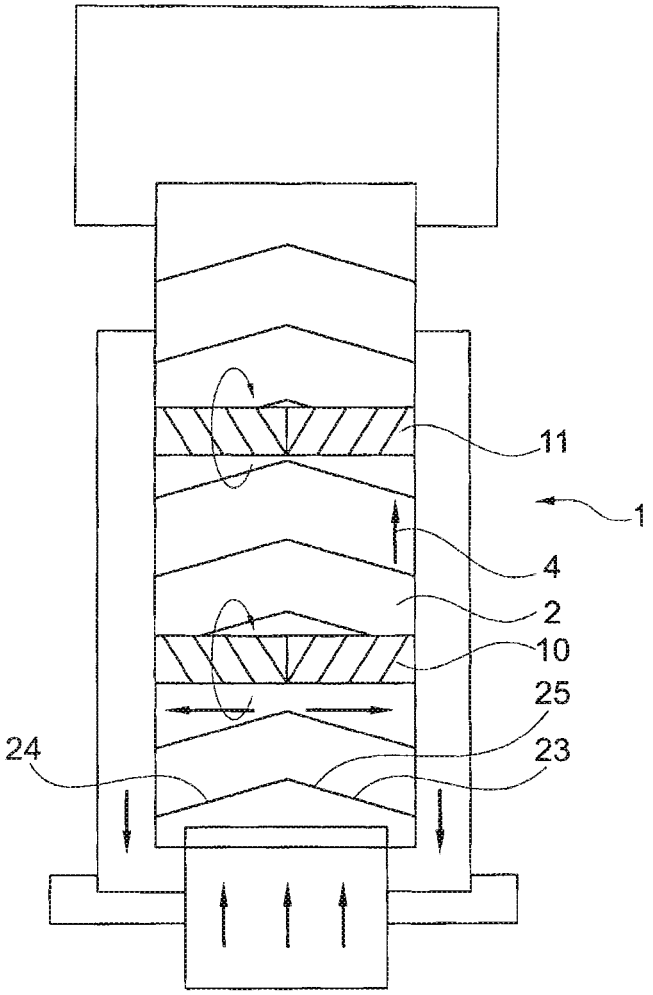
FIG. 2*a* shows a top view onto a second, alternative embodiment of a sorting apparatus comprising a conveyor belt, whereby the means for removing the metal, which cannot be conveyed through the sorting slot, encompass corresponding contour sections on the conveyor belt for transporting the metal in two opposite directions on two sides in addition to a corresponding contouring of the roller.
Figure 2B:
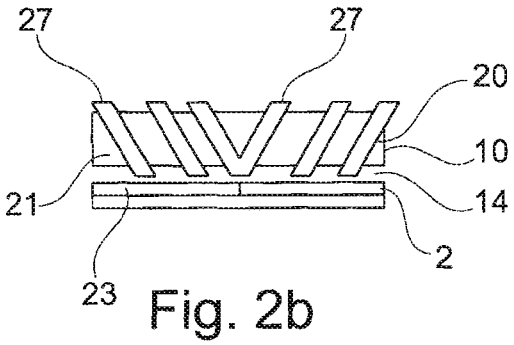
FIG. 2*b* shows a front view onto an apparatus according to FIG. 2*a*, more exactly onto a sorting slot, which is defined by a roller and by the conveyor belt.

FIGS. 2*a* and 2*b* show an alternative sorting apparatus, wherein, to avoid repetitions, substantially the differences as compared to the sorting apparatus according to FIGS. 1*a* and 1*b* are explained. With regard to the commonalities, reference is made to the above figure description along with the corresponding figures.

In FIGS. 2*a* and 2*b*, the means for removing the metal in two opposite directions do not only comprise correspondingly contoured rollers 10, 11, but contour sections 23 on the conveyor belt 2, which extend in a vertical direction vertically to the surface extension of the conveyor belt 2.

In the shown exemplary embodiment, the contour sections consist of the conveyor belt material and comprise two elevations 24, 25, which are inclined outwards relative to the conveying direction. As a whole, an arrow-shaped contour of the contour sections 23 results. It can be seen that a plurality of contour sections are arranged downstream from one another in the conveying direction 4. In any event, the contour sections 23 are contoured such that, in response to rotating rollers 10, 11, the metal, which cannot be conveyed through the sorting slots, is conveyed opposite the conveying direction 4 against the contour sections 23, more accurately against the elevations 24, 25, which are arranged at an angle to the conveying direction, and thus receives a lateral force impulse or is deflected laterally, respectively. In the shown exemplary embodiment, the elevations 24, 25 are distributed evenly to the conveyor belt width, so that the metal, which cannot be conveyed through the sorting slots, is distributed approximately evenly to the two opposite sides.

An embodiment, in the case of which the rollers 10, 11 do not belong to the means for conveying the metal in two opposite directions, that is, in that a removal to the two opposite sides takes place exclusively due to a corresponding contouring of the conveyor belt 2, can also be realized.

In contrast to the exemplary embodiment according to FIGS. 1*a* and 1*b*, the rollers 10, 11 are not embodied as brushes comprising bristle coils, but comprise solid plastic material rings 27, wherein the solid plastic material rings 27 are inclined in different inclined directions from two sections 20, 21 of the roller 10, 11 vertically adjacent to the conveying direction 4, so as to apply a force to the metal towards the corresponding side.

A further alternative exemplary embodiment will be described below by means of FIG. 3, wherein reference is also made herein to above exemplary embodiments and to corresponding descriptions so as to avoid repetitions with regard to commonalities.

Figure 3:
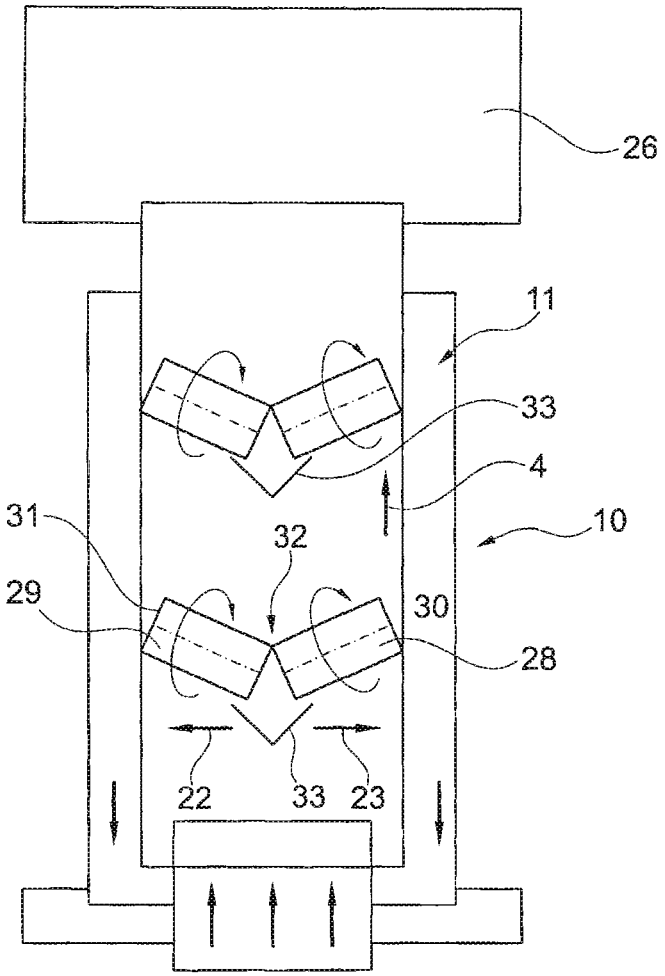
FIG. 3 shows a further alternative sorting apparatus, in the case of which the metal is removed in two opposite directions in that each roller consists of two partial rollers, which are arranged at an angle to one another.

Instead of one-piece or one-part rollers 10, 11, respectively, two partial rollers or independent rollers 28, 29, respectively, are arranged next to one another vertically to the conveying direction in the case of the exemplary embodiment according to FIG. 3, wherein the partial rollers 28, 29 are driven so as to be capable of being rotated about axes of rotation 31, which are arranged at an angle to one another. A central bearing 32 of the partial rollers 28, 29 is located above the conveyor belt 2 and can be provided at a corresponding support structure (not illustrated).

It can be seen from FIG. 3 that provision is made in the areas, which are provided upstream of the bearings 32 in conveying direction 4, for a guide element, in particular a guide sheet 33, by means of which the bulk metal is displaced from a central conveyor belt area in the direction of the partial rollers 28, 29 of the rollers 10, 11.

The invention claimed is:

1. A sorting apparatus for sorting out coins from bulk metal, comprising:

conveying means, provided with a conveyor belt (2), for conveying the bulk metal in a conveying direction (4) to a sorting slot (14) through which coins can pass, wherein the sorting slot (14) is defined by a roller (10, 11), and, on the side opposite the roller (10, 11), by the conveyor belt (2), wherein the roller (10, 11) is rotatable about an axis of rotation (6, 7, 30, 31) by means of a drive such that the bulk metal, which cannot be conveyed through the sorting slot (14) in the conveying direction (4), is transportable by the roller (10, 11) in a direction (13, 19, 22) leading away from the sorting slot (14) such that the bulk metal is removed at the side, wherein the sorting apparatus further comprises means for removing the bulk metal, which is not conveyable through the sorting slot (14) in the conveying direction (4), and wherein the means for removing the bulk metal are embodied such that the removal of the bulk metal to two opposite sides of the conveyor belt takes place in an area in the conveying direction (14) upstream of the roller (10, 11) wherein the roller (10, 11) is contoured such that the bulk metal is removed on the two opposite sides; and wherein the roller (10, 11) encompasses two areas perpendicular to the conveying direction (4) comprising contour sections inclined outwards relative to the radial plane of the roller (10, 11), wherein the contour sections are inclined in different lateral directions for dividing the metal to the two opposite sides.

2. The sorting apparatus according to claim 1, wherein the contour sections, which are formed by bristles or a solid plastic or metal material, are embodied helically, annularly or partially annularly.

3. The sorting apparatus according to claim 1, wherein the roller (10, 11) is embodied in one piece or comprises two partial rollers (28, 29), which are arranged at an angle to one another.

4. A sorting apparatus for sorting out coins from bulk metal, comprising:

conveying means, provided with a conveyor belt (2), for conveying the bulk metal in a conveying direction (4) to a sorting slot (14) through which coins can pass wherein the sorting slot (14) is defined by a roller (10, 11), and, on the side opposite the roller (10, 11), by the conveyor belt (2), wherein the roller (10, 11) is rotatable about an axis of rotation (6, 7, 30, 31) by means of a drive such that the bulk metal, which cannot be conveyed through the sorting slot (14) in the conveying direction (4), is transportable by the roller (10, 11) in a direction (13, 19, 22) leading away from the sorting slot (14) such that the bulk metal is removed at the side, wherein the sorting apparatus further comprises means for removing the bulk metal, which is not conveyable through the sorting slot (14) in the conveying direction (4), and wherein the means for removing the bulk metal are embodied such that the removal of the bulk metal to two opposite sides of the conveyor belt takes place in an area in conveying direction (14) upstream of the roller (10, 11);

wherein the conveyor belt (2) is contoured such that removal of the bulk metal to the two opposite sides takes place in an area in conveying direction (4) upstream of the roller (10, 11); and wherein the conveyor belt (2) encompasses two areas perpendicular to the conveying direction (4) comprising contour sections (23) inclined outwards relative to the conveying direction (4), wherein the contour sections (23) are inclined in different lateral directions.

5. The sorting apparatus according to claim 1, wherein the apparatus includes the roller and at least one additional roller which collectively define a plurality of rollers (10, 11), which in each case define a sorting slot (14) with the conveyor belt (2), and which are arranged downstream from one another in the conveying direction (4), wherein the sorting slots (14), which are spaced apart in the conveying direction (4), encompass a decreasing slot width.

6. The sorting apparatus according to claim 1, wherein provision is made on both sides of the conveyor belt (2) for collecting means and/or transport means for collecting or removing, respectively, removed bulk metal.

* * * * *